US005570004A

United States Patent [19]

Shibata

[11] Patent Number: 5,570,004

[45] Date of Patent: Oct. 29, 1996

[54] SUPPLY VOLTAGE REGULATOR AND AN ELECTRONIC APPARATUS

[75] Inventor: Kimio Shibata, Tokyo, Japan

[73] Assignee: Seiko Instruments Inc., Japan

[21] Appl. No.: 176,717

[22] Filed: Jan. 3, 1994

[51] Int. Cl.[6] ..... G05F 5/00

[52] U.S. Cl. ..... 323/303; 323/274; 323/284

[58] Field of Search ..... 323/299, 303, 323/273, 274, 275, 282, 284, 285, 349, 351

[56] References Cited

U.S. PATENT DOCUMENTS

| | | | |
|---|---|---|---|
| 4,580,090 | 4/1986 | Bailey et al. | 323/303 |
| 4,814,687 | 3/1989 | Walker | 323/303 X |
| 4,827,150 | 5/1989 | Reynal | 363/56 |
| 5,289,361 | 2/1994 | Vinciarelli | 323/299 X |

*Primary Examiner*—Peter S. Wong
*Assistant Examiner*—Y. Jessica Han
*Attorney, Agent, or Firm*—Adams & Wilks

[57] ABSTRACT

In an electronic circuit having a voltage supply means, a load means, and a regulating means, in order to limit the current flowing through a load, a supply voltage/current regulator is provided which comprises a voltage dividing circuit for dividing the supply voltage of a voltage supply, a reference voltage generator for generating a reference voltage, and a differential amplifier for comparing the divider output voltage and the reference voltage and for producing an output signal in accordance with the difference. The output signal is provided to the base of a transistor connected between the voltage supply and the load. The transistor is effective limit the current flow through the load such that the supply voltage does not decrease below a predetermined limit. By limiting the flow of current through the load such that the supply voltage does not decrease below a predetermined limit, the load may be driven continuously without the problem of lock-up common in ordinary voltage regulators. Thus, when the voltage source is a conventional battery, and the internal resistance of the battery increases due to the large load current or low ambient temperature, the load may nevertheless be driven continuously.

11 Claims, 16 Drawing Sheets

IOUT
LOAD CIRCUIT
7
5
4
6
REFERENCE VOLTAGE GENERATOR
10 SUPPLY VOLTAGE REGULATOR
Vd
Vc
2
3
R1
R2
C
B
A
8
r
9
1 BATTERY

SUPPLY VOLTAGE REGULATOR
10
FIRST LOAD CIRCUIT
7
BOOSTER TYPE SWITCHING REGULATOR CONTROLLER
145
142 COIL
143
144
146
SECOND LOAD CIRCUIT
141
1
BATTERY

SUPPLY VOLTAGE REGULATOR AND AN ELECTRONIC APPARATUS

BACKGROUND OF THE INVENTION

1. Field of the Invention

The present invention relates to a supply voltage regulator for regulating the supply voltage of a power supply for an electronic system, such as a radio pager or a portable radio phone, provided with a functional device requiring a comparatively large driving current, such as a vibrator or an alarm device, capable of limiting the current to be supplied to the functional device to prevent the drop of the supply voltage of the power supply below a predetermined lower limit voltage so that the electronic system is able to operate stably without dissipating more supply power than needed.

2. Description of the Related Art

Generally, a supply voltage regulator incorporated into a portable communication apparatus, such as a radio pager or a portable radio phone, is a voltage stabilizer for maintaining the output voltage constant regardless of the variation of the input supply voltage applied thereto. The three-terminal voltage stabilizer of the HA178M00 series (Hitachi Ltd.) shown in FIG. 2 is an example of such a supply voltage regulator. Referring to FIG. 2, the voltage stabilizer 20 that receives the output voltage of a battery 21 and provides a fixed voltage comprises a voltage regulating transistor 25, voltage-dividing resistors R1 and R2 for dividing the output voltage of the voltage regulating transistor 25, a load circuit 27 having a large-current-driven functional device connected to the output side of the voltage stabilizer 20, a reference voltage generator 26 which generates a reference voltage, and a differential amplifier 24. The differential amplifier 24 of the voltage stabilizer 20 compares the reference voltage provided by the reference voltage generator 26 and the divider output voltage provided by the voltage dividing circuit consisting of the resistors R1 and R2, and applies a voltage corresponding to the difference between the reference voltage and the divider output voltage to the base of the voltage regulating transistor 25 to regulate the voltage drop across the emitter and the collector of the voltage regulating transistor 25.

Since the battery 21 has an internal resistance 28 of r, a voltage drop of r·i is produced across the output terminals of the battery 21 when a current i flows through the load circuit 27 and, consequently, $Vout=E-i\cdot r$, where Vout is the output voltage of the battery 21 and E is the electromotive force of the battery 21. Accordingly, the greater the current i that flows through the load circuit 27 the lower is the output voltage Vout. Eventually, the output voltage Vout of the battery 21 decreases below a minimum operating voltage of the differential amplifier 24 or the load circuit 27 and, consequently, the differential amplifier 24 or the load circuit 27 stop their operations.

Even if the output voltage Vout of the battery 21 is sufficiently high, there is the possibility that the output voltage Vout is caused to drop instantaneously below the minimum operating voltages of the differential amplifier 24 or the load circuit 27 by a rush current or a surge current, so that the differential amplifier 24 and the load circuit 27 become unstable and an abnormally large current flows through the differential amplifier 24 and the load circuit 27. In such a case, the voltage stabilizer 20 is unable to restore its normal operating state unless the battery 21 is disconnected from the voltage stabilizer 20 to reset the voltage stabilizer 20. These problems in the conventional voltage stabilizer are attributable to the lack of a sensing function capable of sensing the current that flows through the load circuit 27 taking into consideration the internal resistance 28 of the battery 21, and a limiting function capable of limiting the current that flows through the load circuit 27. Accordingly, once the supply voltage $V_{BAT}$ of the battery 21 decreases below a predetermined lower limit voltage, the electronic system including the voltage stabilizer 20 and the load circuit 27 stops its operation even if the battery 21 has a sufficient capacity.

FIG. 3 shows an electronic system incorporating another known voltage stabilizer 20 proposed to solve the problems in the foregoing voltage stabilizer 20 shown in FIG. 2. As shown in FIG. 3, a voltage detector 32 is connected in parallel to the battery 21 to detect the supply voltage $V_{BAT}$ of the battery 21, i.e., the voltage across the output terminals of the battery 21. A load circuit 27 requiring a large current is connected through a switching circuit 33 to the output side of the voltage stabilizer 20, and electronic system circuit 31 comprising a CPU, a ROM, a RAM and peripheral circuitry is connected across the output terminals of the battery 21.

In normal operation, the switch circuit 33 is closed to supply a large current to the load circuit 27 to drive the latter and, when the supply voltage $V_{BAT}$ of the battery 21 drops below a predetermined lower limit voltage, the voltage detector 32 inverts its output to open the switch circuit 33, so that the load circuit 27 is disconnected from the battery 21. Since the load circuit 27 is thus disconnected from the battery 21, the supply voltage $V_{BAT}$ of the battery 21 can be maintained above the minimum operating voltage of the electronic system circuit 31 to avoid the interruption of the electronic system circuit 31. The supply voltage Vsub of the battery 21 increases gradually to its normal level while the load circuit 27 is disconnected therefrom. However, since the load circuit 27 is disconnected from the battery 21, the functional device of the load circuit 27, such as a vibrator or an alarm, is unable to function when necessary.

Since the foregoing known voltage stabilizer 20 is incapable of limiting the current flowing through the load circuit 27, the supply voltage $V_{BAT}$ of the battery 21 is reduced by a voltage drop attributable to the internal resistance 28 and, consequently, the electronic system circuit 31, as well as the load circuit 27, stops its operation. Thus, the electronic system including the load circuit 27, such as a portable info-communication apparatus, is unable to function continuously and stably within the life of the battery 21. Therefore, it has been necessary to provide the electronic system with a backup battery in addition to the main battery 21. Operating conditions for the electronic system at a comparatively low temperature is more severe than those at an ordinary temperature because the internal resistance 28 of the battery increases at a comparatively low temperature and a large current flows through the load circuit 27. Accordingly, the operating temperature range of the electronic system is narrowed inevitably. Since the electronic system need the peripheral circuits including the voltage detector 32 and the switch circuit 33 in addition to the voltage stabilizer 20, those peripheral circuits increases the power consumption and the cost of the electronic system.

SUMMARY OF THE INVENTION

Accordingly, it is an object of the present invention to provide a supply voltage regulator capable of solving the foregoing problems in an electronic system provided with the known voltage stabilizer, of securing the stable operation of the functional device of the electronic system and of making the electronic system exhibit its intrinsic functions.

A supply voltage regulator in one aspect of the present invention comprises: a current control signal generating circuit for detecting the supply voltage of a power supply for supplying a driving current to a load circuit and generating a current control signal to control the current flowing through the load circuit; and a load current limiting circuit for limiting the current to be supplied to the load circuit by the power supply according to a current control signal generated by the current control signal generating circuit.

The current control signal generating circuit detects a divider output voltage obtained by dividing the supply voltage of the power supply, compares the divider output voltage and a reference voltage, and the load current limiting circuit controls the current flowing through the load circuit according to the difference between the divider output voltage and the reference voltage to suppress the free variation of the load current. Thus, the drop of the supply voltage of the power supply below a predetermined voltage level can be prevented regardless of voltage drop across the output terminals of the power supply attributable to the internal resistance of the power supply. Accordingly, an electronic system powered by the power supply is able to operate stably and-the load circuit requiring a large current is able to be driven by a limited current.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
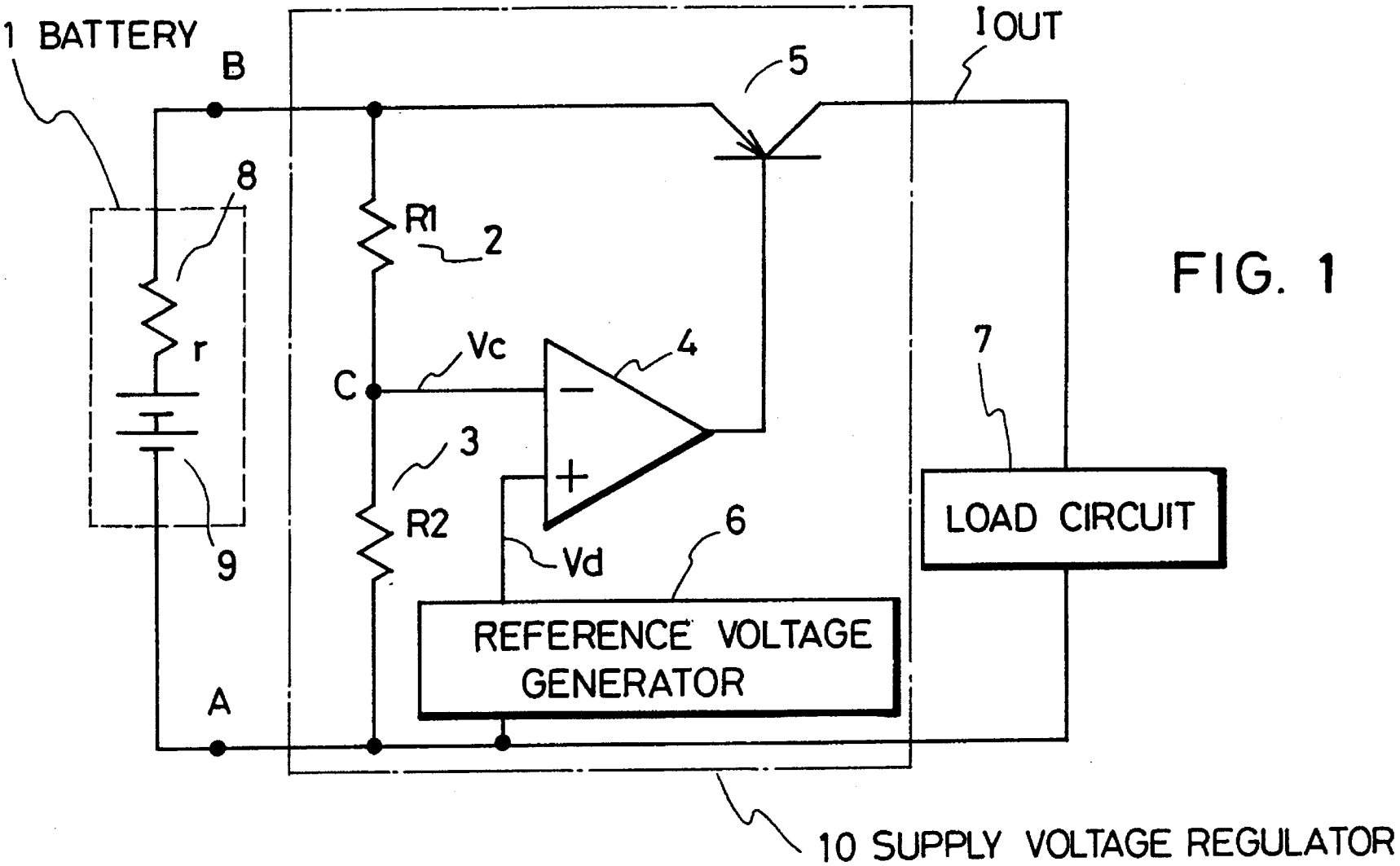
FIG. 1 is a block diagram of an electronic system provided with a supply voltage regulator in a first embodiment according to the present invention.
Figure 2:
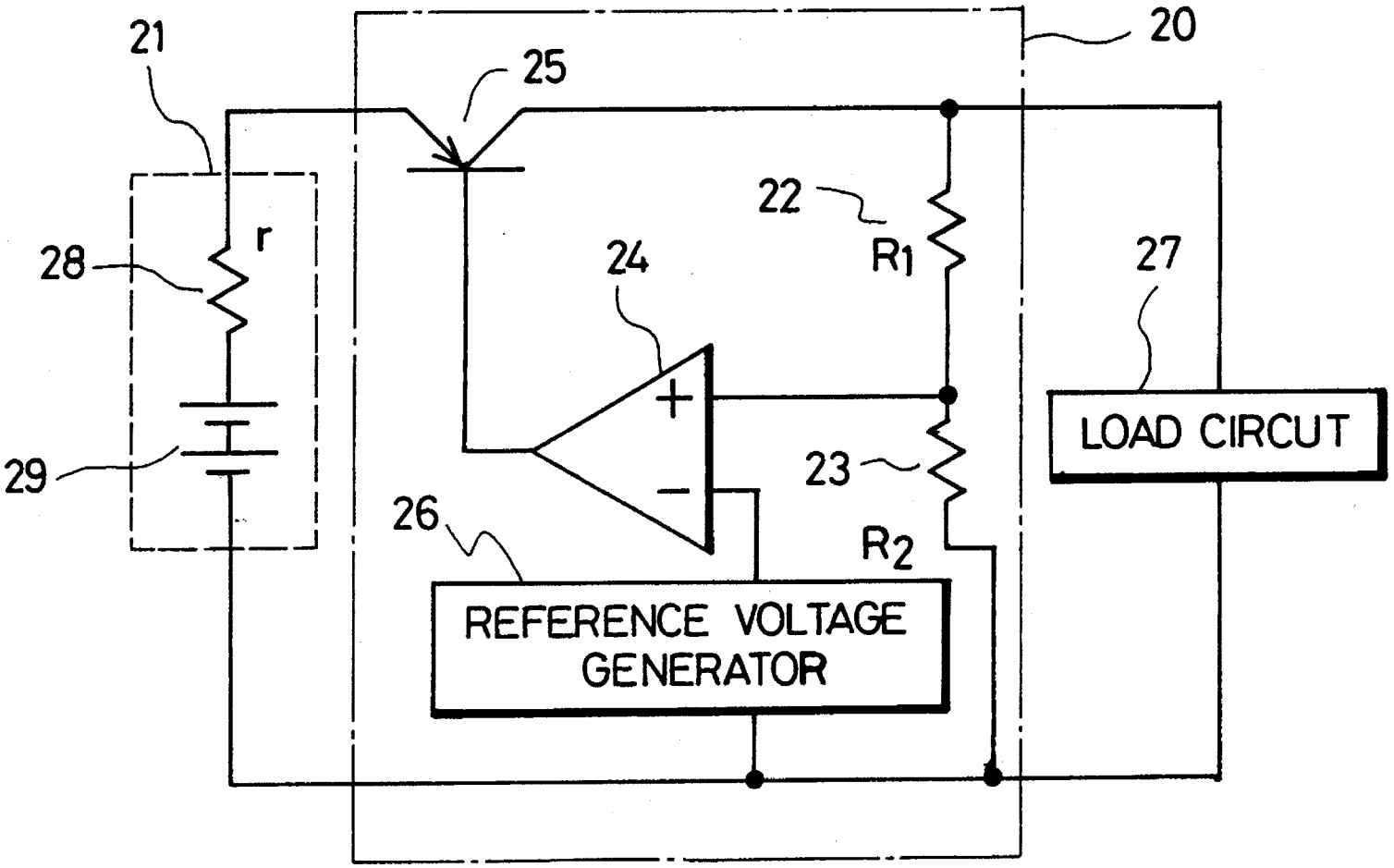
FIG. 2 PRIOR ART
FIG. 2 is a block diagram of an electronic system provided with a known supply voltage regulator.
Figure 3:
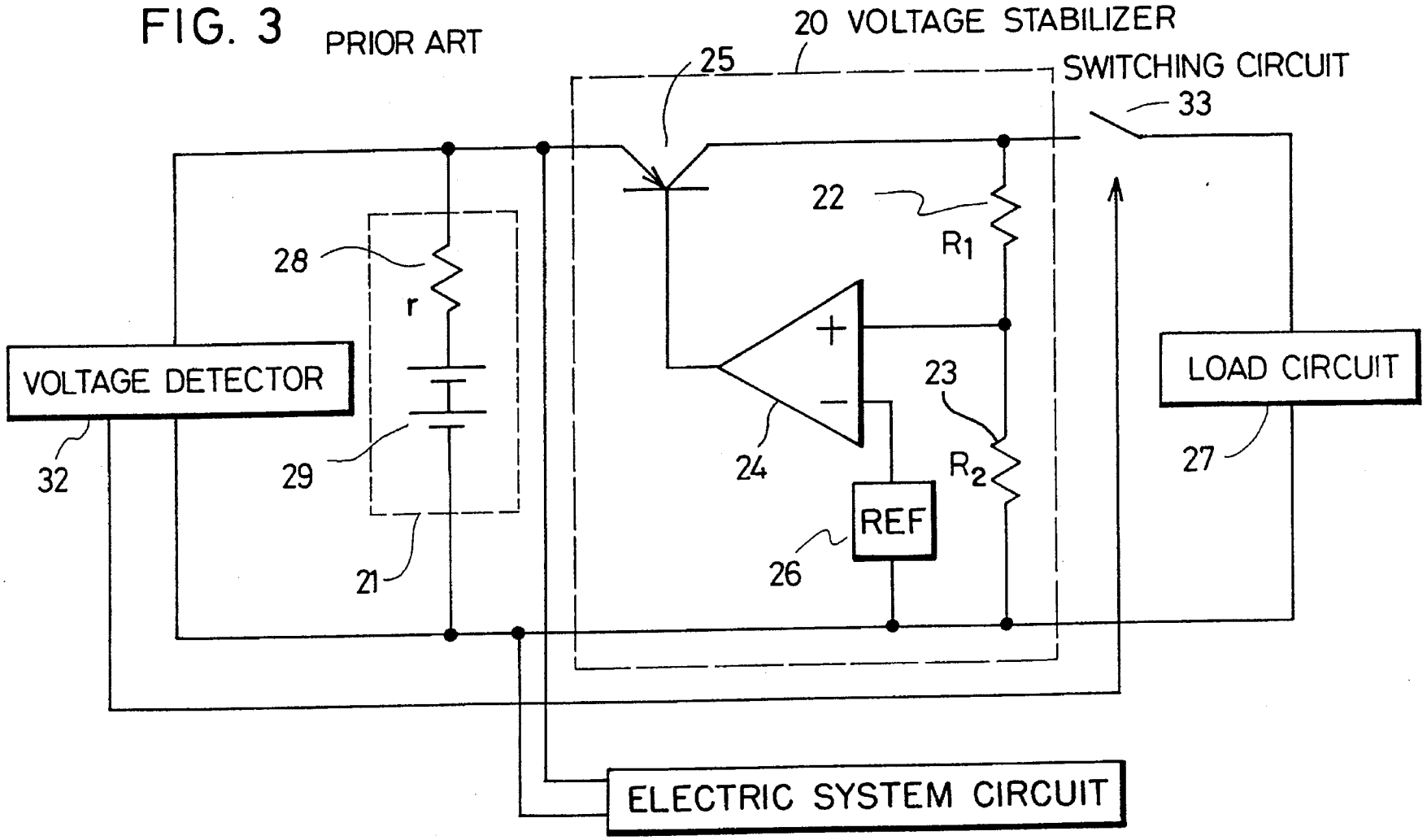
FIG. 3 PRIOR ART
FIG. 3 is a block diagram of an electronic system provided with another known supply voltage regulator.

Referring to FIG. 1, a supply voltage regulator 10 embodying the present invention comprises a voltage dividing circuit consisting of dividing resistors R1 and R2 for dividing the supply voltage of a battery 1, a reference voltage generator 6 that generates a reference voltage, a differential amplifier 4 that compares a divider output voltage Vc provided by the voltage dividing circuit and a reference voltage Vd, i.e., the output voltage of the reference voltage generator 6, and a transistor 5 that limits the current flowing through a load circuit 7 according to the output voltage of the differential amplifier 4. The positive terminal of a battery 1 having an internal resistance 8 of a value of r is connected to the emitter of the transistor circuit 5 and the voltage dividing circuit. The collector of the transistor 5 is connected to a load circuit 7. The load circuit 7 is provided with a functional device that requires a large driving current, such as a vibrator driven for vibration generation by a miniature motor having an eccentric drive shaft, a miniature electromagnetic buzzer or an electronic device, such as LED display. The resistances of the dividing resistors R1 and R2 are far greater than the internal resistance r, which is within the range of 1 to 20 Ω.

Figure 4:
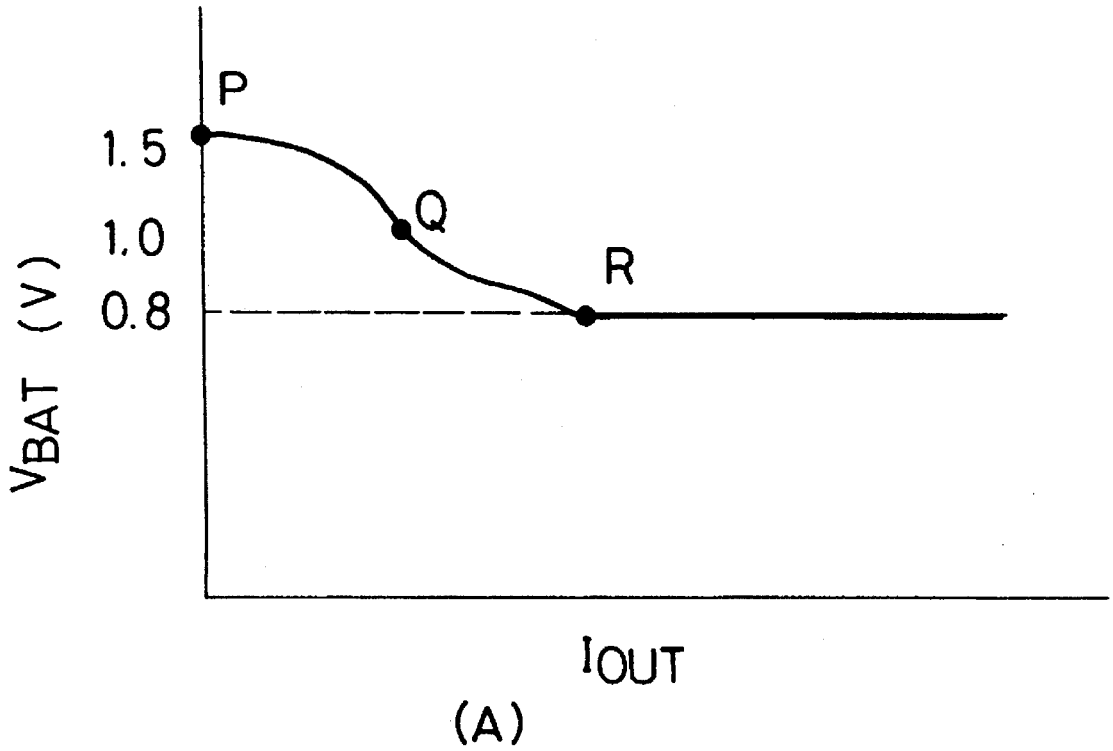
FIG. 4 is a graph showing the relation between load current provided by the supply voltage regulator of FIG. 1 and regulated voltage.

The operation of the supply voltage regulator of FIG. 1 will be described hereinafter with reference to FIG. 4 showing the relation between the supply voltage of the battery 1 and the current flowing through the load circuit 7, in which the supply voltage $V_{BAT}$, i.e., the voltage across points A and B in FIG. 1, is measured on the vertical axis, and the current Iout that flows through the load circuit 7 is measured on the horizontal axis. In a state represented by a point P in FIG. 4, where the functional device of the load circuit 7 is not driven, voltage drop across the battery 1 attributable to the internal resistance 8 of the value r is small because only a small current flows through the load circuit 7. In this state represented by the point P in FIG. 4, the supply voltage $V_{BAT}$ of the battery 1 is, for example 1.5 V. Suppose that the resistance ratio between the resistors R1 and R2 of the voltage dividing circuit is 1:1, the reference voltage Vd provided by the reference voltage generator 6 is 0.4 V and the value r of the internal resistance 8 of the battery 1 is on the order of 5 Ω . Then, the divider output voltage Vc is 0.75 V. Since the divider output voltage Vc of 0.75 V is far higher than the reference voltage Vd of 0.4 V, the output of the differential amplifier 4 is LOW. Consequently, the internal resistance of the transistor 5 is biased so that voltage drop occurs scarcely across the emitter and collector of the transistor 5 and the supply voltage $V_{BAT}$ of 1.5 V of the battery 1 is applied to the load circuit 7.

Suppose that the functional device of the load circuit 7 is driven by an external driving signal and the current I required by the load circuit 7 increases gradually to a value corresponding to a point Q (FIG. 4). Then, the supply voltage $V_{BAT}$ is caused to decrease gradually to 1.0 V corresponding to the point Q (FIG. 4) by the voltage drop r·I and the divider output voltage Vc is reduced to 0.5 V. In this state, since the divider output voltage Vc of 0.5 V is higher than the reference voltage Vd of 0.4 V, the output of the differential amplifier 4 still remains LOW to bias the internal resistance of the transistor 5 is biased so that voltage drop occurs scarcely across the emitter and the collector of the transistor 5. Accordingly, the supply voltage Vsup of 1.0 V is applied to the load circuit 7.

The supply voltage $V_{BAT}$ of the battery 1 decreases as the current demand of the load circuit 7 increases. Upon the drop of the supply voltage $V_{BAT}$ to a voltage on the order of 0.8 V corresponding to a point R (FIG. 4), the divider output voltage Vc coincides with the reference voltage Vd. Then, the output of the differential amplifier 4 changes gradually toward HIGH and, consequently, the emitter-collector resistance of the transistor 5 increases to reduce the collector current. As the current demand further increases, the divider output voltage Vc decreases below the reference voltage Vd and, consequently, the output of the differential amplifier 4 goes HIGH to turn off the transistor 5, so that the load circuit 7 is disconnected from the battery 1. Accordingly, the supply voltage $V_{BAT}$ of the battery 1 increases and the output of the differential amplifier 4 goes LOW again to turn on the transistor 5. This operation for turning on and off the transistor 5 is repeated to maintain the supply voltage $V_{BAT}$ of the battery 1 above 0.8 V.

Even if the functional device of the load circuit 7, such as the vibrator driven by the miniature motor having the eccentric drive shaft, is driven in a state where the energy of the battery 1 has been almost exhausted and the battery 1 is in the last stage of its useful life or in a state where the value r of the internal resistance 8 of the battery 1 has been increased to a value on the order of 20 Ω due to the drop of the ambient temperature, the supply voltage $V_{BAT}$ of the battery 1 is maintained at the predetermined lower limit voltage of 0.8 V, because the reference voltage Vd remains constant while the divider output voltage Vc drops when the supply voltage $V_{BAT}$ drops, the voltage difference between the reference voltage Vd and the divider output voltage Vc decreases and, consequently, the output of the differential amplifier 4, i.e., a bias voltage applied to the base of the transistor 5, changes to reduce the current flowing through the transistor 5, i.e., the current supplied to the load circuit 7. When the supply voltage $V_{BAT}$ of the battery 1 is lowered to 0.8 V by an action of the current flowing through the load circuit 7 and the internal resistance 8 of the battery 1, the divider output voltage Vc drops to 0.4 V, which is equal to the reference voltage Vd of 0.4 V. Since the current supplied ho the load circuit 7 is thus limited, the supply voltage $V_{BAT}$ of the battery 1 does not decrease below 0.8 V.

Figure 5:
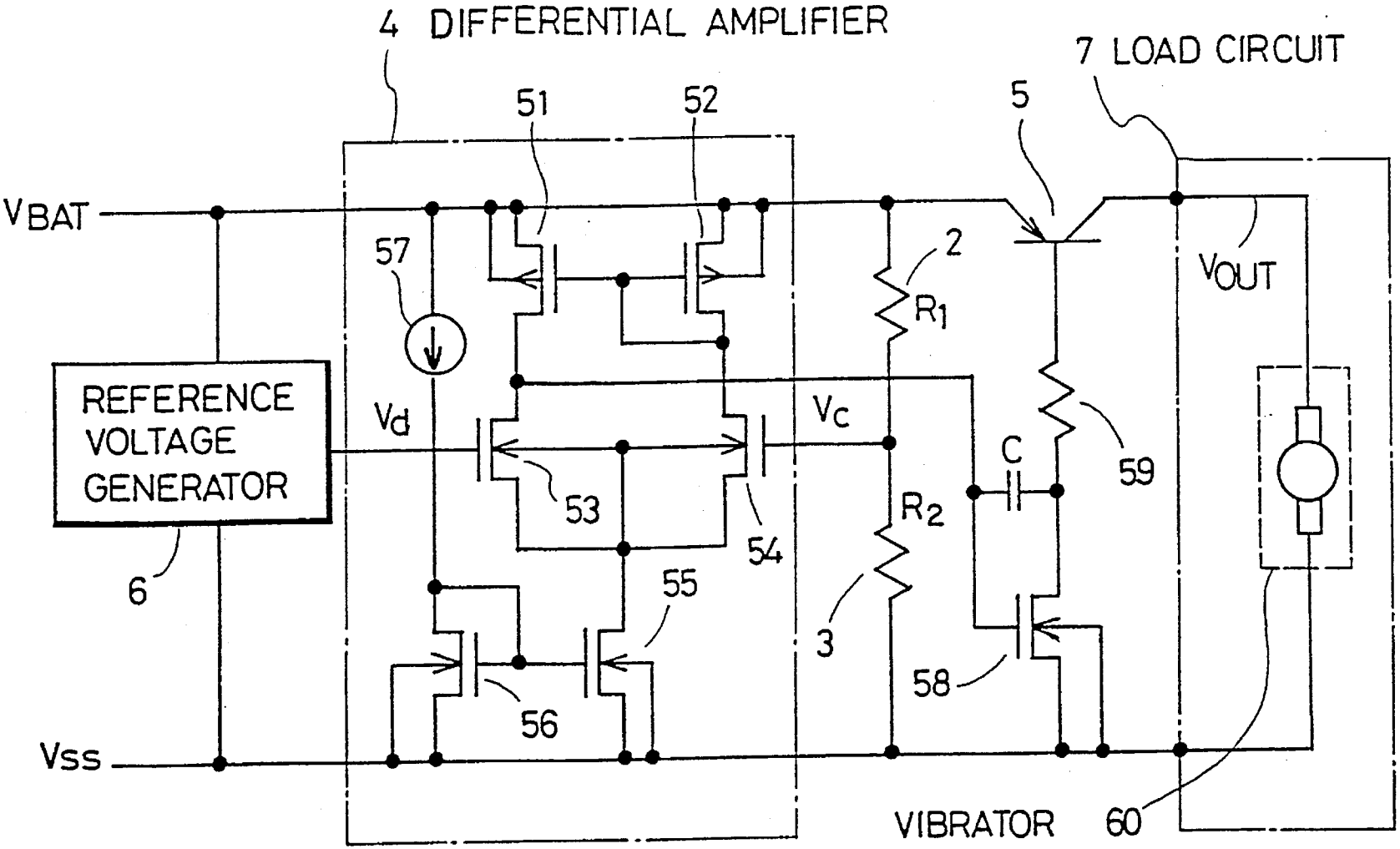
FIG. 5 is a circuit diagram of the supply voltage regulator of FIG. 1.

Referring to FIG. 5 showing the circuit configuration of the supply voltage regulator 10 of FIG. 1 in detail, the supply voltage regulator has input terminals $V_{BAT}$ and $V_{SS}$ connected to the battery 1. The reference voltage Vd provided by the reference voltage generator 6 and the divider output voltage Vc provided by the voltage dividing circuit are applied respectively to the gate of a transistor 53 included and the gate of a transistor 54 included in the differential amplifier 4. The differential amplifier 4 has an output circuit comprising a current limiting resistor 59 and a base current regulating transistor 58. The transistor 5 serves as a current limiting device. The load circuit 7 is provided with a vibrator 60. The differential amplifier 4 has a constant-current circuit consisting of a constant-current regulated power supply 57, an n-channel transistor 56 that provides a fixed bias voltage, and an n-channel transistor 55 biased by the fixed bias voltage provided by the n-channel transistor 56. A series circuit of a p-channel transistor 51 and an n-channel transistor 53, and a series circuit of a p-channel transistor 52 and an n-channel transistor 54 are symmetrical. The respective gates of the p-channel transistors 51 and 52 are connected to the drain of the p-channel transistor 52. Therefore, the same current flows through the p-channel transistors 51 and 52. A phase compensating capacitor C is connected across the gate and the drain of an n-channel transistor 58 to stabilize the operation of the supply voltage regulator 10.

The operation of the supply voltage regulator 10 will be described hereinafter with reference to FIG. 5. When the supply voltage $V_{BAT}$ of the battery 1, i.e., the voltage across the input terminals $V_{BAT}$ and $V_{SS}$, is 1.5 V (high voltage), the voltage dividing circuit provides a divider output voltage Vc of 0.75 V, which is higher than the reference voltage Vd of 0.4 V provided by the reference voltage generator 6. Therefore, a voltage at-the drain of the n-channel transistor 53 is far higher than a voltage at the drain of the n-channel transistor 54. The voltage that appears at the drain of the n-channel transistor 53 is applied to the gate of the n-channel transistor 58 to bias the n-channel transistor 58 so that the resistance of the same is reduced to a sufficiently low degree. Consequently, the base current of the transistor 5 increases and the transistor 5 is biased so that voltage drop occurs scarcely across the emitter and the collector of the same, and a voltage nearly equal to 1.5 V is applied to the load circuit 7.

In a condition where the load circuit 7 requires a large current and the supply voltage $V_{BAT}$ of the battery 1, i.e., the voltage across the input terminals $V_{BAT}$ and $V_{SS}$, has dropped to about 0.8 V, which occurs in a state where the battery 1 is in the last stage of its useful life or in a state where the internal resistance of the battery 1 has increased due to the drop of the ambient temperature, the divider output voltage Vc decreases to about 0.4 V and the drain voltage of the n-channel transistor 53 drops to a voltage nearly equal to the drain voltage of the n-channel transistor 54. Consequently, the n-channel transistor 58 is biased so that the resistance increases, and the base current of the transistor 5 decreases to limit the load current that flows through the load circuit 7. If the supply voltage $V_{BAT}$ of the battery 1 decreases further below 0.8 V, the drain voltage of the n-channel transistor 53 drops below the drain voltage of the n-channel transistor 58. Consequently, the base current of the transistor 5 decreases to zero to disconnect the load circuit 7 from the battery 1. Then, the supply voltage $V_{BAT}$ of the battery 1 increases again. Thus, the supply voltage regulator 10 prevents the supply voltage $V_{BAT}$ of the battery 1 from decreasing below 0.8 V.

Figure 13:
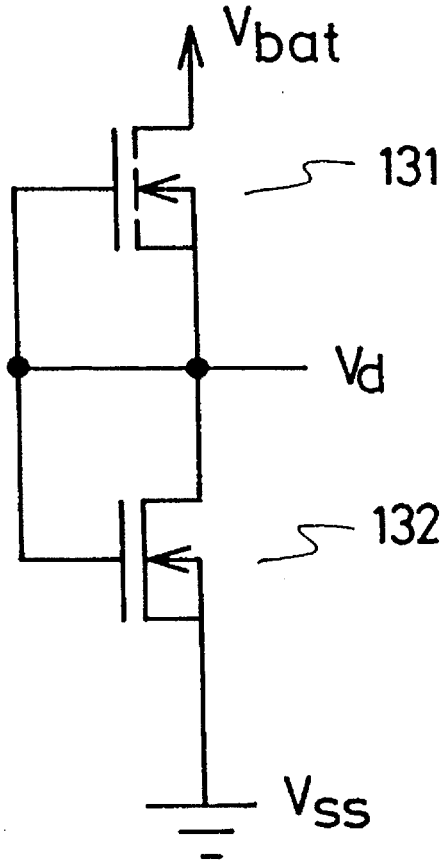
FIG. 13 is a circuit diagram of a reference voltage generator.

Referring to FIG. 13 showing the circuit configuration of the reference voltage generator 6, a depletion MOSFET 131 having a threshold voltage Vth2 and an enhancement MOSFET 132 having a threshold voltage Vth1 different from the threshold voltage Vth2, which are the same in the type of conduction, are connected in series with their gates connected respectively to their drains, and the same gate voltage is applied to the depression MOSFET 131 and the enhancement MOSFET 132. Then, the reference voltage Vd equal to the threshold voltage difference between the depletion MOSFET 131 and the enhancement MOSFET 132, i.e., (Vth1)−(Vth2), appears at the drains at a low current consumption. This reference voltage generator 6 has stable temperature characteristics and the reference voltage Vd thus generated is stable. Further a deviation value of the reference voltage Vd is small. This reference voltage generator 6 is disclosed in, for example, Japanese Patent Laid-open (Kokai) No. 55-11021.

Figure 6:
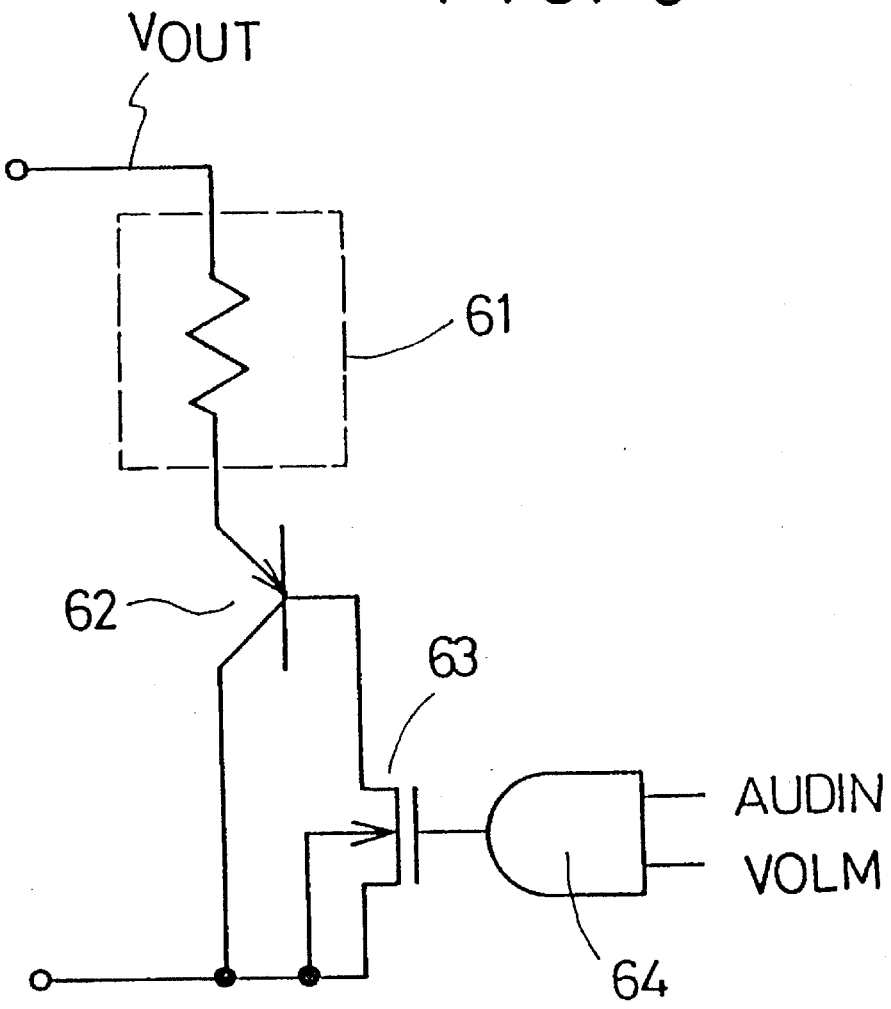
FIG. 6 is a circuit diagram of a driving circuit for driving a miniature buzzer, i.e., a load circuit.

Referring to FIG. 6 showing a configuration of the load circuit 7 including a miniature buzzer 61, a transistor 62 has an emitter connected to the miniature buzzer 61, and a base connected to an n-channel transistor 63. The output signal of an AND circuit 64 is given to the gate of the n-channel transistor 63. A pulse signal AUDIN of an audio frequency in the range of 2 kHz to 3 kHz and a pulse signal VOLM of a frequency in the range of 20 kHz to 30 kHz are applied to the input terminals of the AND circuit 64. The n-channel transistor 63 is turned on when both the pulse signals AUDIN and VOLM are HIGH, and then a base current flows to supply a collector current to the transistor 62. Consequently, the coil of the miniature buzzer 61 wound on a core is energized and the electromagnetic force generated by the coil vibrates a diaphragm to generate an alarm sound.

Figure 7:
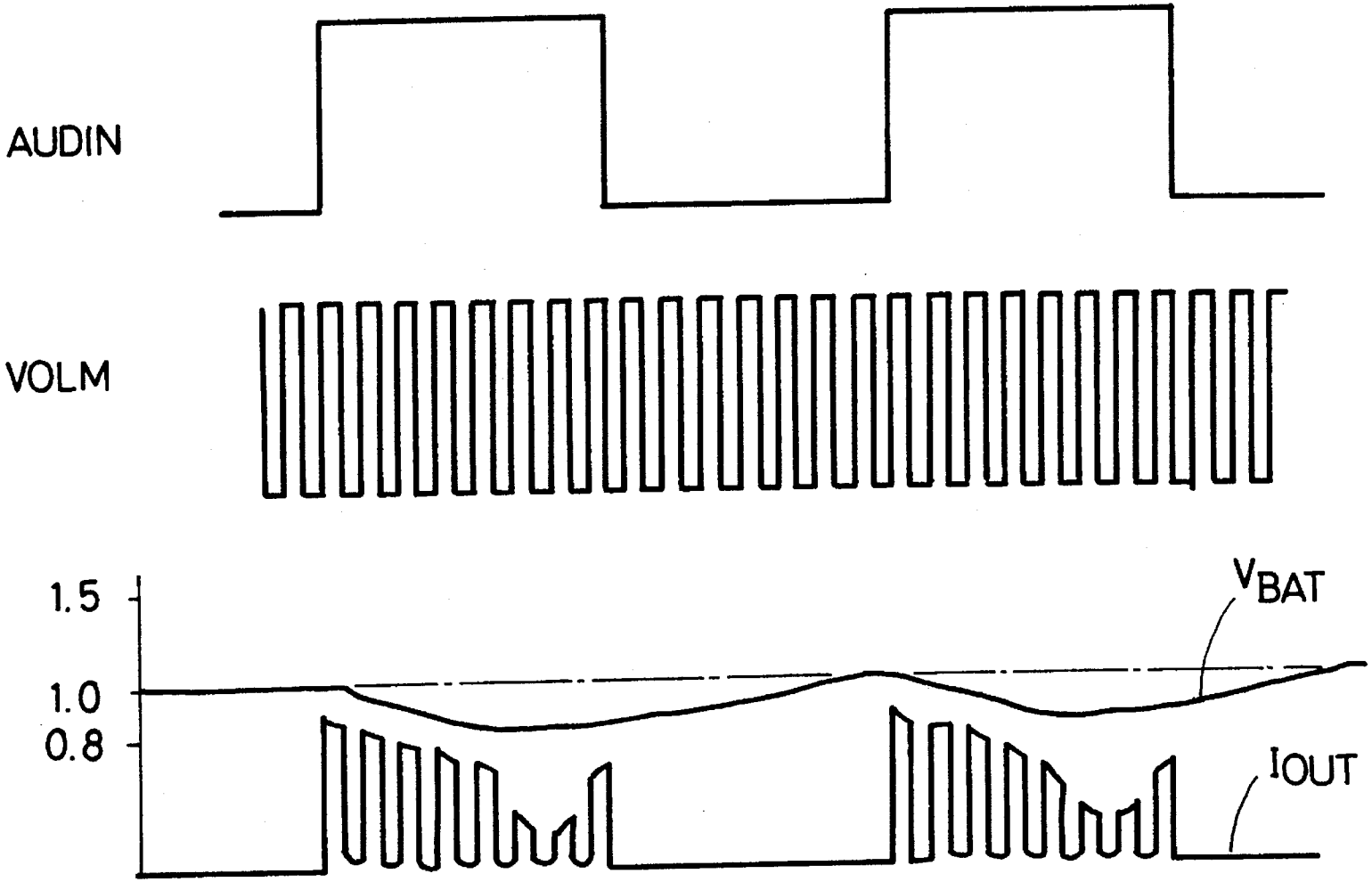
FIG. 7 is a diagram showing the waveforms of supply voltage applied to the miniature buzzer and driving current supplied to the same.

FIG. 7 shows the waveforms of the pulse signals AUDIN and VOLM, the supply voltage $V_{BAT}$ of the battery 1 and the driving current Iout supplied to the miniature buzzer 61. It is understood from FIG. 7 that the driving current Iout flowing through the miniature buzzer 61 is limited so that the supply voltage $V_{BAT}$ of the battery 1 will not drop below 0.8 V even if the driving current Iout tends to increase when the supply voltage $V_{BAT}$ of the battery 1 drops to 1.0 V due to increase in the internal resistance of the battery 1 and the current demand of the components of the electronic system, and the supply voltage $V_{BAT}$ of the battery 1 recovers to 1.0 V while the miniature buzzer 61 is stopped. Thus, the supply voltage $V_{BAT}$ of the battery 1 will not drop below a predetermined lower limit voltage even if the current Iout flowing through the load circuit 7 increases. It is known from the waveform of the driving current Iout that supply voltage regulator is capable of controlling the volume of the alarm sound.

Figure 8:
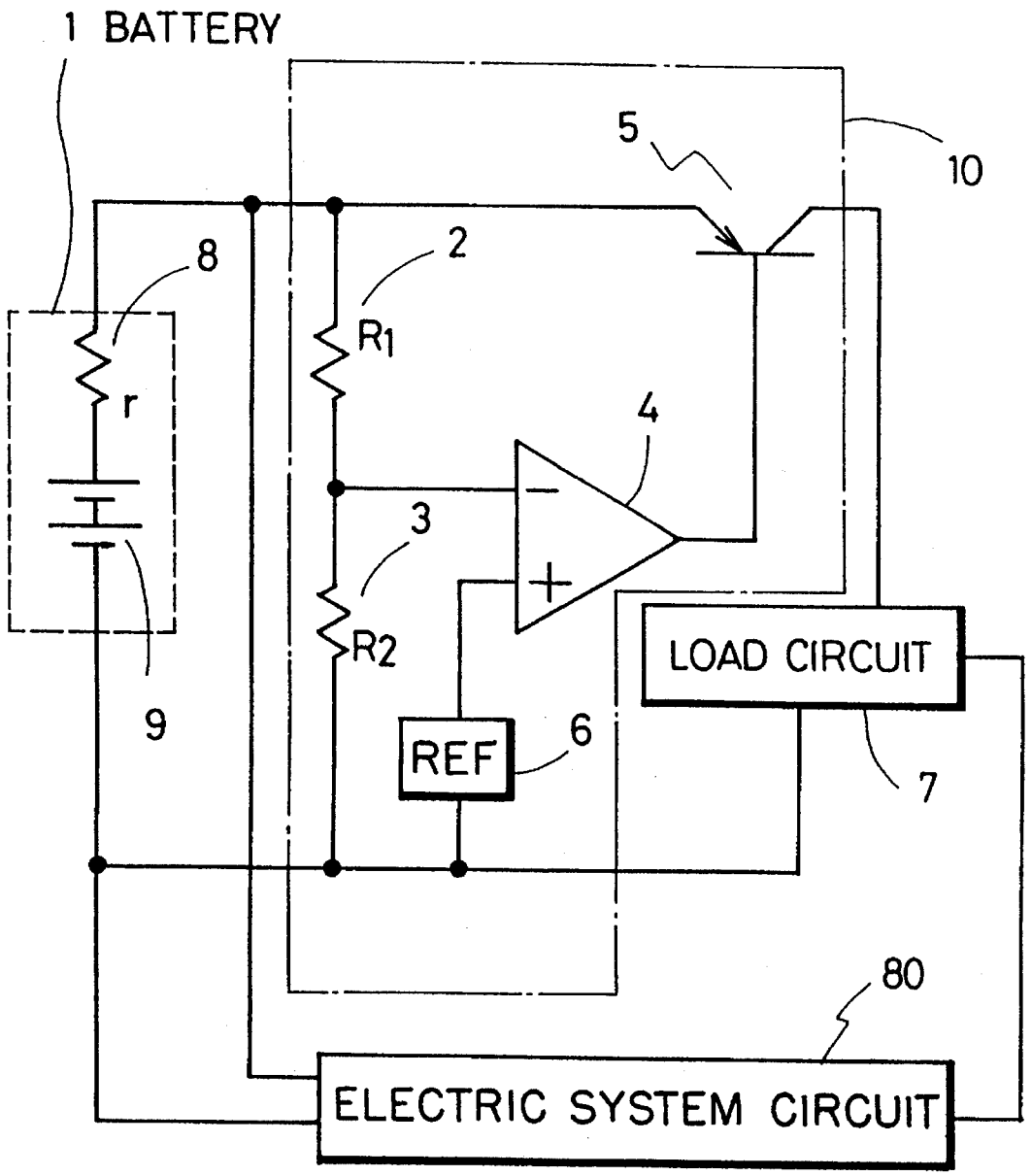
FIG. 8 is a block diagram of an electronic system in a second embodiment according to the present invention.

FIG. 8 shows an electronic system in a second embodiment according to the present invention provided with the supply voltage regulator 10 shown in FIG. 1. Referring to FIG. 8, a load circuit 7 is connected to the output terminal of the transistor 5 serving as a current limiting device of the supply voltage regulator 10, and an electronic system circuit 80 is connected to the input side of the supply voltage regulator 10. The load circuit 7 is provided with a functional device requiring a large current. The electronic system circuit 80 provides a control signal to control the functional device of the load circuit 7 for on-off operation. The operation of the supply voltage regulator 10 is the same as-that described above and the description thereof will be omitted. In this electronic system, the supply voltage of the battery 1 is prevented from dropping below a predetermined lower limit voltage by the supply voltage regulator 10 even if the current flowing through the load circuit 7 tends to increase. The predetermined lower limit voltage is not lower than the minimum operating voltage of the electronic system circuit 80.

Figure 9:
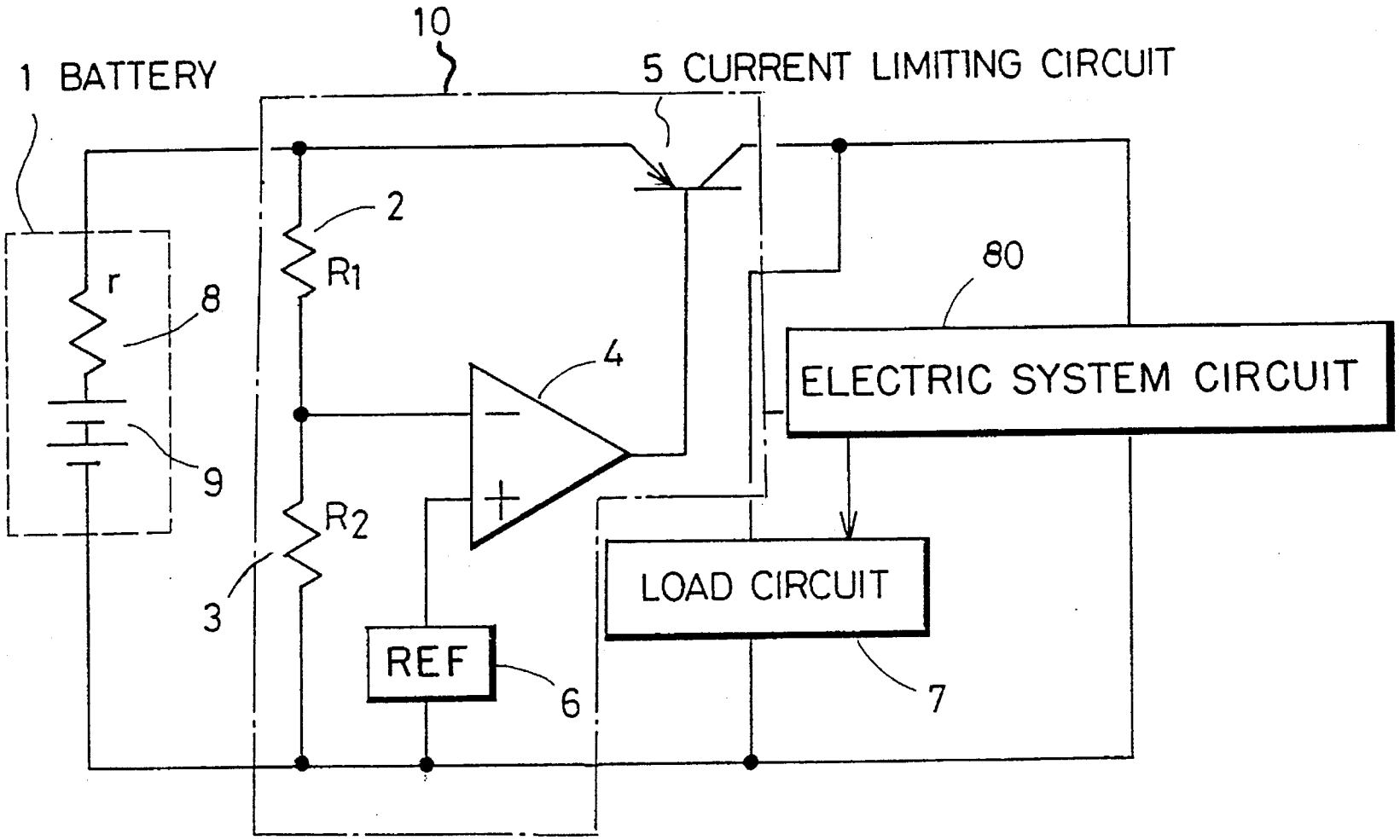
FIG. 9 is a block diagram of an electronic system in a third embodiment according to the present invention.

FIG. 9 shows an electronic system in a third embodiment according to the present invention provided with the supply voltage regulator 10 of FIG. 1. Referring to FIG. 9, an electronic system circuit 80 is connected to the output terminal of the transistor 5 serving as a current limiting device. The electronic system circuit 80 controls the operation of a functional device included in a load circuit 7. As described above, the supply voltage of the battery 1 input is prevented from dropping below a predetermined lower limit voltage even if the current flowing through the load circuit tends to increase. Accordingly, the voltage that appears at the output terminal of the transistor 5 is maintained at a voltage level not lower than the minimum operating voltage of the electronic circuit 80 to secure the stable operation of the electronic circuit 80.

The transistor 5 may be either a pnp bipolar transistor or an npn bipolar transistor. Additionally, the transistor 5 may be a MOSFET.

Figure 15:
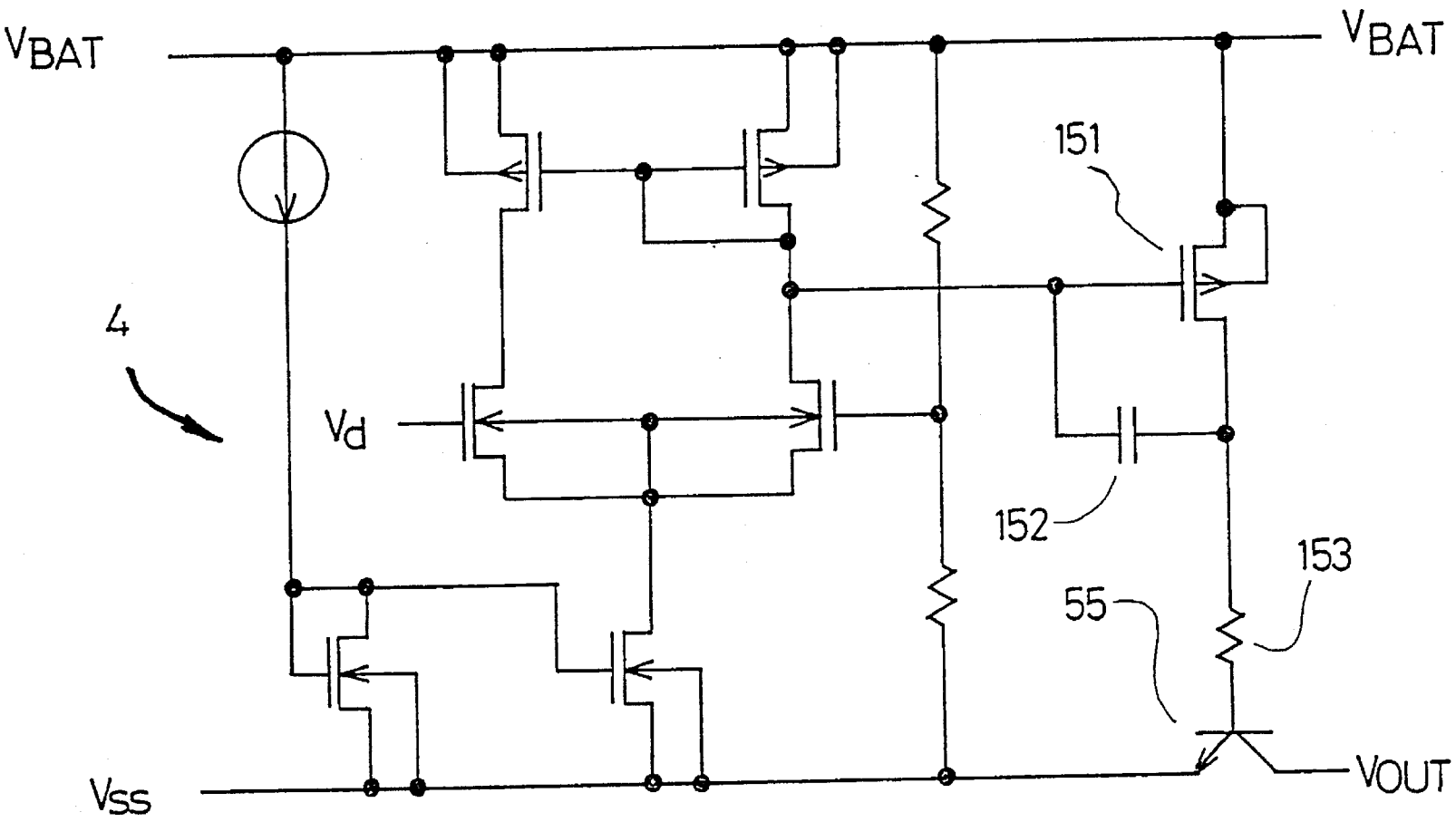
FIG. 15 is a circuit diagram of a supply voltage regulator in a second embodiment according to the present invention.

FIG. 15 shows a supply voltage regulator in a second embodiment employing an npn bipolar transistor instead of the pnp bipolar transistor employed in the supply voltage regulator 10 of FIG. 1.

Referring to FIG. 15, the output circuit of a differential amplifier 4 comprises a p-channel transistor 151, a current limiting resistor 153 and a phase compensating capacitor 152. An npn transistor 55 comprises the current limiting circuit. The operation of the differential amplifier is the same as that of the differential amplifier shown in FIG. 5 and hence the description thereof will be omitted. The output of the differential amplifier is applied to the gate of the p-channel transistor 151. When the supply voltage is sufficiently high, the output of the differential amplifier goes LOW and, consequently, the resistance of the p-channel transistor 151 decreases and the base current of the npn transistor 55 increases. Therefore, the on-state resistance across the emitter and the collector of the npn transistor 55 is reduced sufficiently and the current flowing through the load circuit increases. On the contrary, the output of the differential amplifier increases accordingly as the decrease of the supply voltage of the battery; consequently, the on-state resistance of the p-channel transistor 151 increases, the base current of the same decreases, and the on-state resistance of the npn-transistor 55 increases to limit the current flowing through the load circuit.

Figure 16:
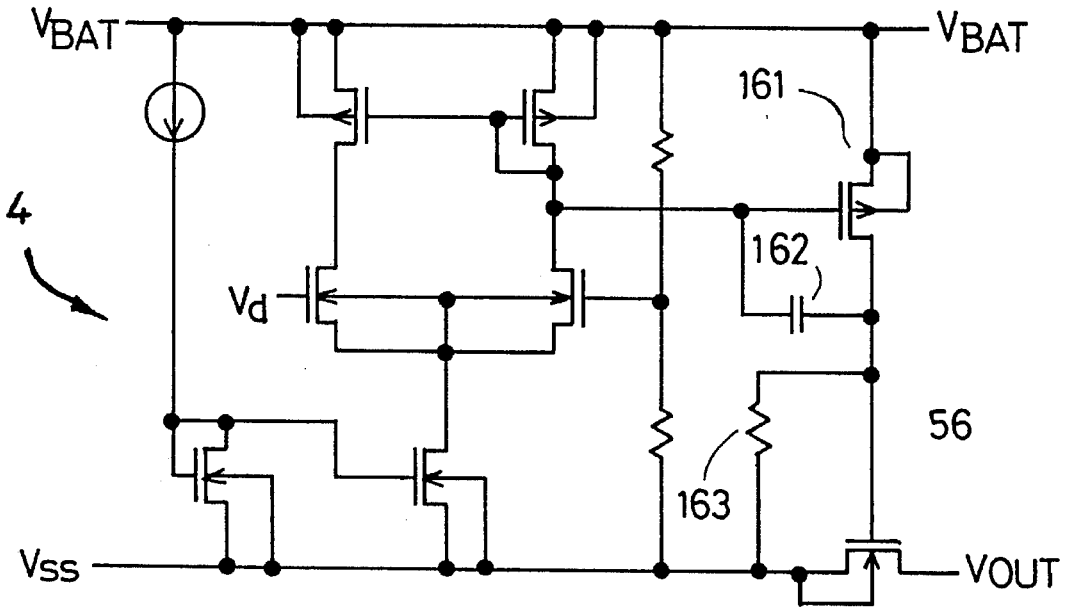
FIG. 16 is a circuit diagram of a supply voltage regulator in a third embodiment according to the present invention.

FIG. 16 is a supply voltage regulator in a third embodiment employing an n-channel MOSFET instead of the pnp bipolar transistor 5.

Referring to FIG. 16, the output circuit of a differential amplifier 4 comprises a p-channel transistor 161, a phase compensating capacitor 162 and a voltage dividing resistor 163. An n-channel MOSFET 56 comprises the current limiting circuit. The operation of the differential amplifier 4 is the same as that shown in FIG. 5 and hence the description thereof will be omitted. The output of the differential amplifier 4 is given to the gate of the p-channel transistor 161. When the supply voltage of the battery is sufficiently high, the output of the differential amplifier 4 is LOW and the on-state resistance of the p-channel transistor 161 decreases; consequently, the divider output voltage determined by the voltage dividing resistor 163 increases and the gate voltage of the n-channel MOSFET 56 increases. Therefore, the on-state resistance of the n-channel MOSFET t6 is reduced sufficiently to increase the current flowing through the load circuit. The output of the differential amplifier 4 increases according as the decrease of the supply voltage of the battery, and the on-state resistance of the p-channel transistor 161 increases, so that the divider output voltage decreases; consequently, the on-state resistance of the n-channel MOSFET increases to limit the current flowing through the load circuit.

Figure 17:
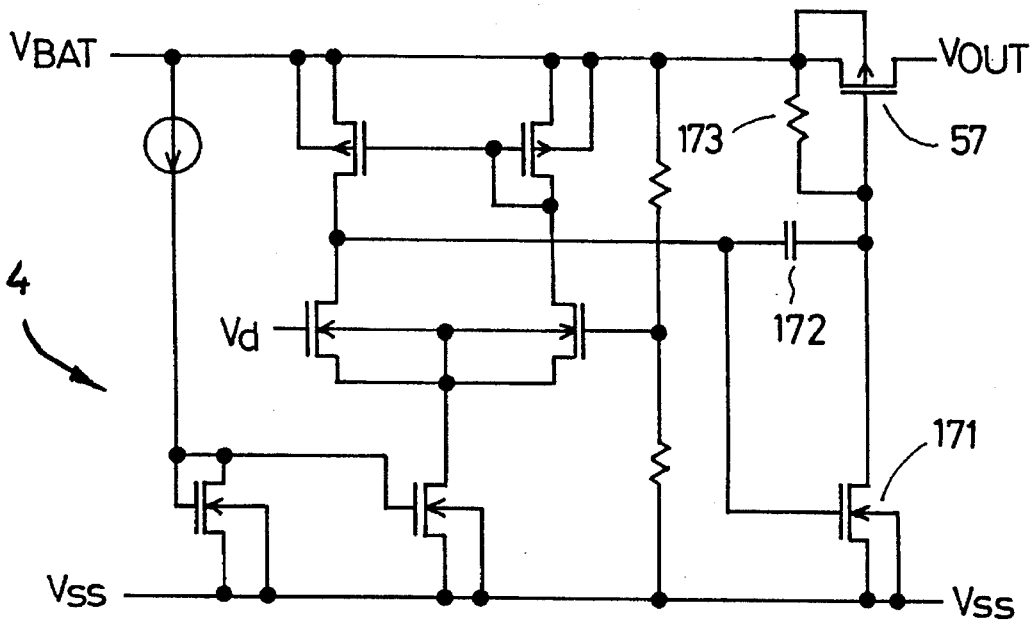
FIG. 17 is a circuit diagram of a supply voltage regulator in a forth embodiment according to the present invention.

FIG. 17 shows a supply voltage regulator in a fourth embodiment employing a p-channel MOSFET instead of the pnp bipolar transistor 5.

Referring to FIG. 17, the output circuit of the differential amplifier 4 comprises an n-channel transistor 171, a phase compensating capacitor 172 and a voltage dividing resistor 173. A p-channel MOSFET 57 comprises the current limiting circuit. The operation of the differential amplifier 4 is the same as that of the differential amplifier shown in FIG. 5 and hence the description thereof will be omitted. The output of the differential amplifier 4 is supplied to the gate of the n-channel transistor 171. When the supply voltage of the battery is sufficiently high, the output of the differential amplifier 4 is HIGH and the on-state resistance of the n-channel transistor 171 decreases; consequently, the divider output voltage determined by the voltage dividing resistor 173 decrease and the gate voltage of the n-channel MOSFET 57 decreases. Therefore, the on-resistance of the MOSFET 57 decreases sufficiently to increase the current flowing through the load circuit. The output of the differential amplifier 4 decreases according as the decrease of the supply voltage of the battery, so that the on-resistance of the n-channel transistor 171 increases, consequently, the on-state resistance of the n-channel MOSFET 57 increases to limit the current flowing through the load circuit.

Figure 10:
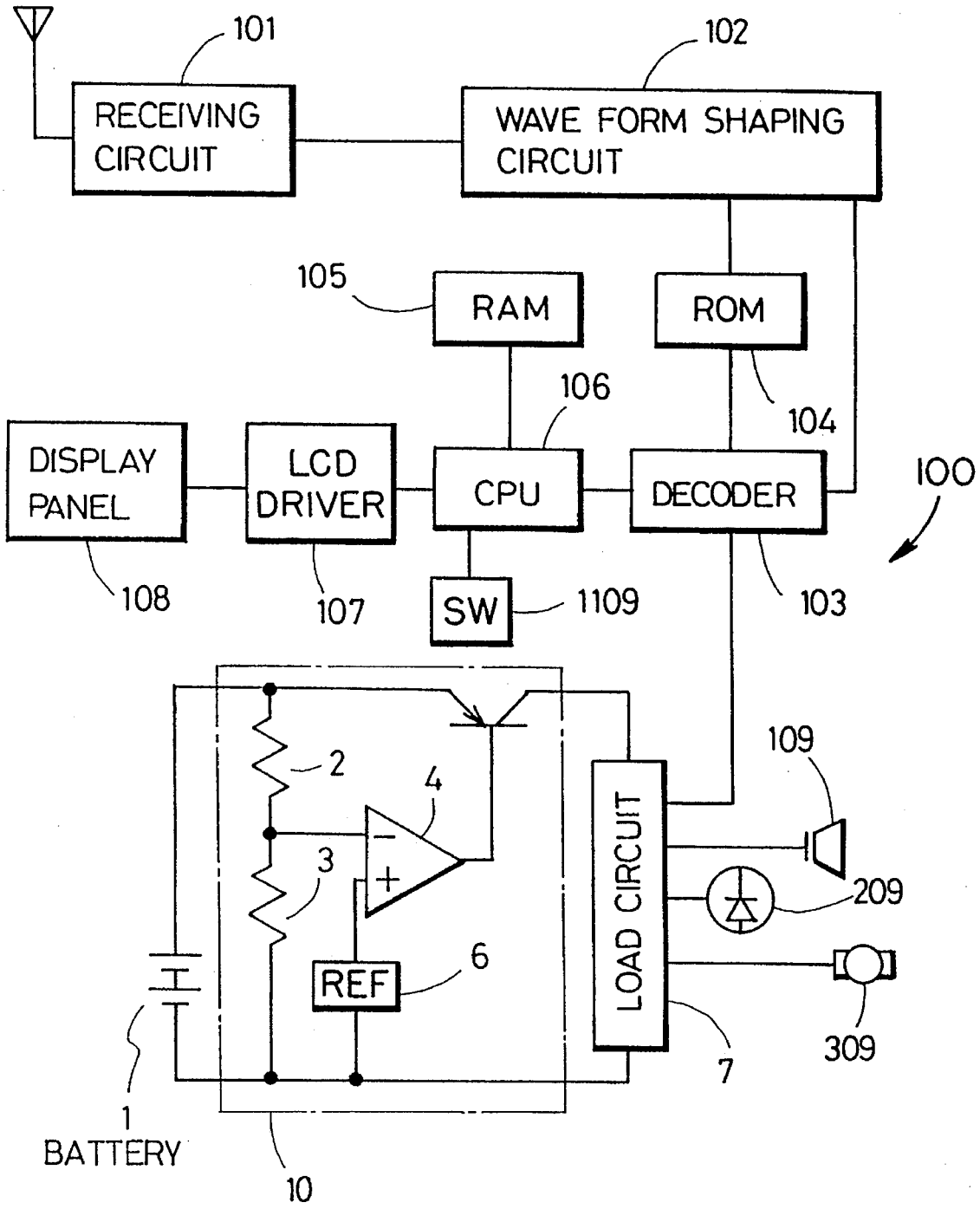
FIG. 10 is a block diagram of a radio pager in a fourth embodiment according to the present invention.

FIG. 10 shows a radio pager 100, i.e., the electronic system circuit, in a fourth embodiment according to the present invention provided with the supply voltage regulator 10 of FIG. 1.

Referring to FIG. 10, the electronic circuit of the radio pager 100 comprises a receiving circuit 101 for receiving a call signal modulating a carrier wave, a waveform shaping circuit 102 for converting a signal filtered by the low-pass filter of the receiving circuit 101 into a corresponding digital call signal, a decoder 103 for decoding the digital call signal, a ROM 104 storing a private number, a CPU 106 for processing the output signal of the decoder 103, a RAM 105 storing messages, a switching circuit 1109 for external operation, a liquid crystal display panel 108 for displaying the output signal of the CPU 106, and a driving circuit 107 for driving the liquid crystal display panel 108.

A load circuit 7 is provided with functional devices including at least a miniature buzzer 109, a LED indicator 209 and a vibrator 309 having a miniature motor, which require large driving currents. The functional devices can be selectively operated by the user. A battery 1 applies a supply voltage to the electronic system circuit. The digital call signal provided by the waveform shaping circuit 102 is given to the decoder 103. Then, the decoder 103 compares the private number stored in the ROM 104 with a call number represented by the call signal. If the call number coincides with the private number, the decoder 103 provides a control signal to drive the functional devices of the load circuit 7. The functional devices are driven continuously for a predetermined time period unless the switching circuit 1109 is operated to stop the functional devices. The decoder 103 gives a message data representing a message included in-the call signal to the CPU 106. The message data given to the CPU 106 is stored in the RAM 105, the message data is converted into corresponding display data and the display data is given to the driving circuit 107 to display the message for a predetermined time. Upon the reception of another call signal, the foregoing procedure is executed to compare the call number with the private number and to give control signals to the functional devices, and the new message signal is stored in a storage location of the next address in the RAM 105. At the same time, a message is displayed and the call messages are stored sequentially. The messages stored in the RAM 105 can be displayed on the display 108 in the reverse order of reception by operating the memory switch of the switching circuit 1109.

Figure 11:
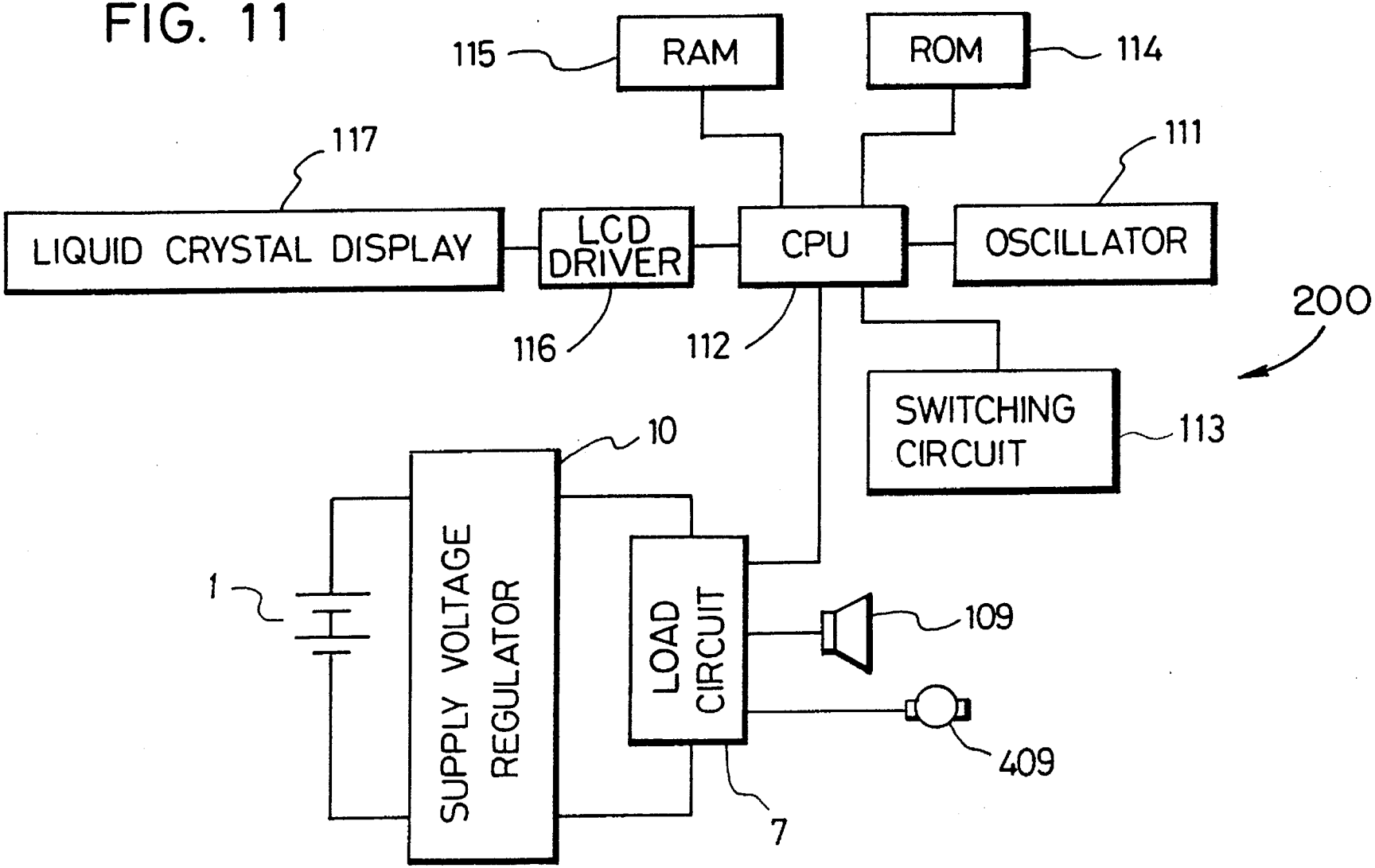
FIG. 11 is a block diagram of an electronic watch in a fifth embodiment according to the present invention.

FIG. 11 shows a hybrid electronic watch 200, i.e., an electronic system circuit, in a fifth embodiment provided with the supply voltage regulator of the present invention.

Referring to FIG. 11, the electronic system circuit 200 comprises a CPU 112, an oscillator 111, a ROM 114 storing programs to be executed by the CPU 112, a frequency divider for dividing a frequency of a clock signal generated by the oscillator 111, a RAM 115 for storing the count of the divided clock signal, a liquid crystal display 117, a display driving circuit 116 for driving the liquid crystal display 117 to display the time, and switching circuit 113 for time adjustment and resetting. A load circuit 7 has functional devices including at least a miniature buzzer 109 and a stepping motor 409, which require large driving currents. The output voltage of the supply voltage regulator 10 is applied to the load circuit 7. The hybrid electronic watch is capable of indicating the time in both digital and analog forms and of sounding an alarm.

The alarm is set for an alarm time by the external operation of the switching circuit 113. The alarm time is stored in the RAM 115. A plurality of alarm times can be stored in the RAM 115. The CPU 112 compares the alarm time and the time indicated by the electronic watch and, upon the coincidence of the alarm time with the time indicated by the electronic watch, gives a control signal to the load circuit 7 to drive the miniature buzzer 109 so that the miniature buzzer 109 will generate alarm sound for a predetermined period. The CPU 112 gives a driving signal of 1 Hz obtained by dividing the clock signal to the load circuit 7 to drive the stepping motor 409 to indicate the time in an analog form. The set alarm time can be displayed on the liquid crystal display 117 by operating the switching circuit 113. Either the output voltage of the supply voltage regulator 10 or the supply voltage of the battery 1 may be applied Lo the electronic system circuit.

Figure 12:
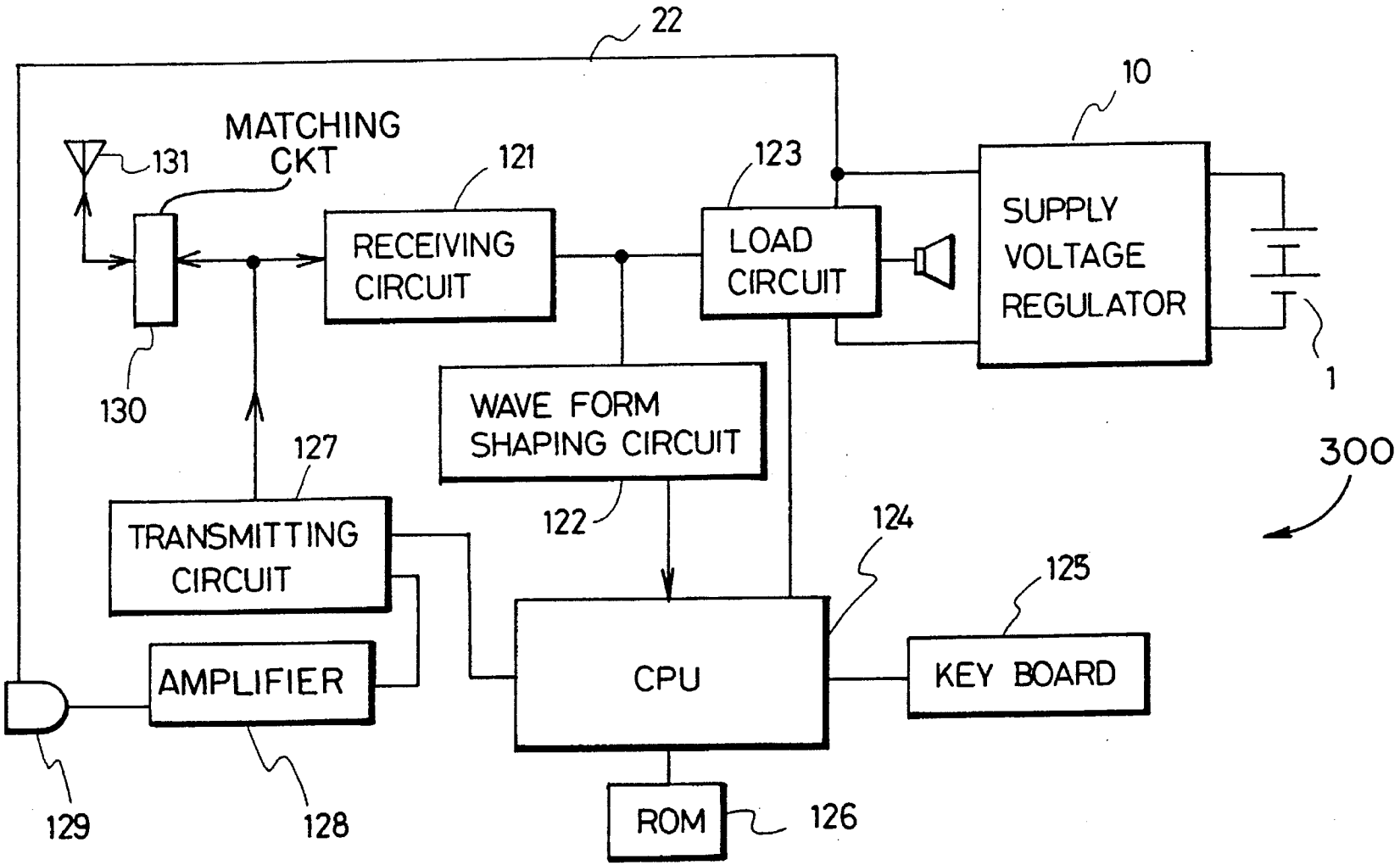
FIG. 12 is a block diagram of a portable radio phone in a sixth embodiment according to the present invention.

FIG. 12 shows a portable radio phone 300, i.e., an electronic system circuit, in a sixth embodiment employing the supply voltage regulator of the present invention.

Referring to FIG. 12, an electronic circuit for a portable radio phone 300 comprises a receiving antenna 131 for receiving radio waves, a matching circuit 130 for the maximum transfer of the energy of the received signal, a receiving circuit 121 that amplifies the carrier signal of the received radio waves and filters the amplified carrier signal to extract a received signal, a waveform shaping circuit 122 for converting the received signal provided by the receiving circuit 121 into a corresponding digital signal, a CPU 124 for processing the output digital signal of the waveform shaping circuit 122, a keyboard 125 for entering a telephone number, a ROM 126 for storing a private telephone number, a microphone 129 that generates sending signals, an amplifier 128 for amplifying the sending signals generated by the microphone 129, and a transmitting circuit 127 that produces a modulated carrier modulated by the telephone number provided by the CPU 124 and the sending signals provided by the amplifier 128. A load circuit 123 has functional devices including at least a miniature loud speaker, a miniature buzzer and a microphone, which require large driving currents. The output voltage of the supply voltage regulator 10 is applied to the load circuit 123.

Upon the detection of the coincidence of a specified number with the private telephone number by the CPU 124, the miniature buzzer of the load circuit 123 is driven to generate a ringback tone. When the handset is picked up, speech signals included in the received signals are given as driving signals to the miniature loudspeaker of the load circuit 123, and then the miniature loud speaker generates speech. Sound signals applied to the microphone 129 are amplified by the amplifier 128, and the amplified sound signals are subjected to frequency modulation and transmitted by the transmitting circuit 127.

Figure 14:
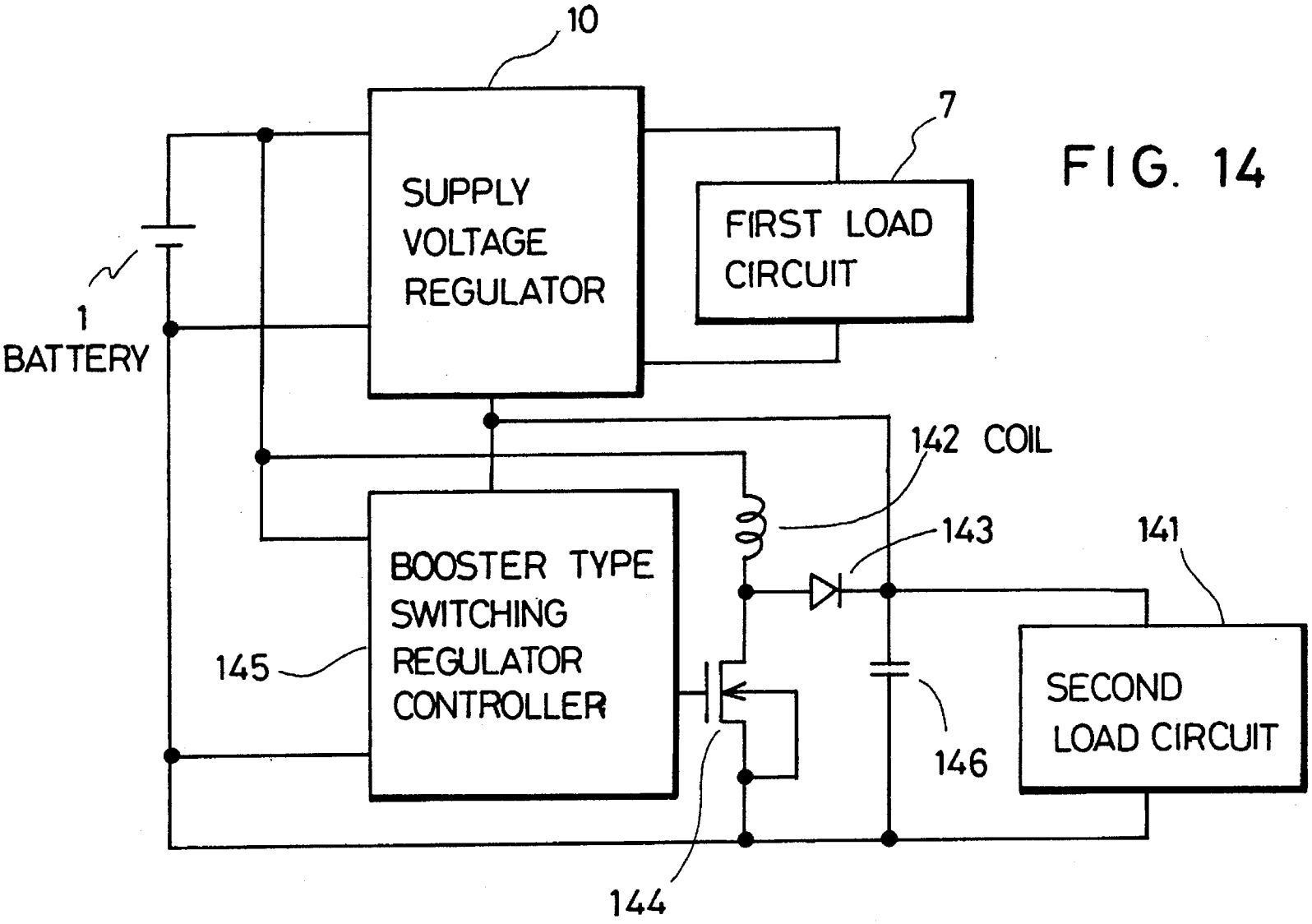
FIG. 14 is a block diagram of the electronic system having a booster type switching regulator in a seventh embodiment according to the present invention.

FIG. 14 shows a Booster type switching regulator controller, i.e., the electronic system circuit employing the supply voltage regulator of the present invention.

Referring to FIG. 14, the supply voltage of a battery 1 is applied to the Booster type switching regulator controller 145. A booster type coil 142 has one end connected to a positive terminal of the battery 1 and the other end connected to a switching transistor 144. A Schottky diode 143 is connected to the junction of the boosting coil 142 and the switching transistor 144. The output terminal of the Schottky diode 146 is connected to a smoothing condenser 143 and a load circuit 141, i.e., an electronic circuit.

The load circuit comprises an LCD, a CPU, a RAM and such requiring power of a voltage higher than the supply voltage of the battery 1. This embodiment is used when the load circuit 141 needs a booster type power supply or when an amplifier or a comparator requiring power of a polarity reverse to that of the battery. This embodiment employs the Schottky diode because voltage drop across the Schottky diode is smaller than that across the ordinary diode and the Schottky diode enhances the boosting efficiency.

The supply voltage of the battery 1 is applied to the supply voltage regulator 10, and the regulated output voltage of the supply voltage regulator 10 is applied to the load circuit 7. The booster type switching regulator controller 145 applies a switching pulse signal to the gate of the switching transistor 144 to supply an intermittent current to the boosting coil 142, so that a boosted voltage appears at the junction of the boosting coil 142 and the switching transistor 144. A dc boosted voltage obtained and smoothed by the Schottky diode 143 and the smoothing condenser 146 is applied to the load circuit 141 (i.e. electronics system circuit).

The boosted voltage may be used as a supply voltage to be applied to the differential amplifier of the supply voltage regulator 10. If the boosted voltage provided by the boosting circuit and higher than the supply voltage of the battery 1 is applied to the differential amplifier 4, the operating range of the differential amplifier 4 is expanded, so that the supply voltage regulator 10 is able to operate more stably. The use of the booster type switching regulator 145 prevents the drop of the supply voltage of the battery 1 below the minimum operating voltage of the booster type switching regulator controller 145 even if large currents flow through the functional devices of the load circuit 7 and, consequently, stable operation of the electronic system can be secured.

The use of the boosted voltage obtained by boosting the supply voltage of the battery as the input voltage of the differential amplifier expands the operating range of the differential amplifier, which increases the degree of freedom of design.

As is apparent from the foregoing description, the supply voltage regulator of the present invention limits the current flowing through the load circuit according to the difference between the voltage divider output voltage and the reference voltage, while the conventional voltage regulator maintains its output voltage constant by suppressing the variation of its input voltage. Thus, the supply voltage regulator prevents the drop of the supply voltage below a predetermined lower limit voltage to secure the stable operation of the electronic system circuit powered by the power supply. Thus, the minimum operating voltage of the electronic system circuit can be secured even in a state where the energy of the battery has decreased and the internal resistance of the battery has increased, and the electronic system circuit is able to operate stably until the end of the useful life of the battery. Accordingly, the useful life of the battery included in the electronic system is extended and the electronic system need not be provided with any backup power supply.

Even if a large current flows through the load circuit in a state where the ambient temperature is comparatively low or in a state where the battery is in the last stage of its useful life and the internal resistance of the battery is comparatively large, the electronic system is able to operate in a wide operating temperature range because the current flowing through the load circuit is limited to prevent the drop of the supply voltage of the battery below a predetermined lower limit voltage. Even if the supply voltage has dropped, the current flowing through the load circuit is limited and the load circuit need not be disconnected from the battery, so that the functional device, such as the alarm or the vibrator, is able to function. Furthermore, the present invention is capable of securing the stable operation of an electronic circuit provided with a switching regulator and requiring a voltage higher than the supply voltage of the power supply or a voltage of a polarity reverse to the supply voltage until the end of the useful life of the battery.

The supply voltage regulator of the present invention can be used also as a control circuit for preventing instantaneous interruption of power supply, which occurs when an excessive current flows through the load circuit due to rush current or surge current, in an electronic apparatus provided with a CPU, such as a personal computer, and provided with a constant-voltage power supply connected to a commercial power source.

Although the invention has been described in its preferred form with a certain degree of particularity, obviously many changes and variations are possible therein.

It is therefore to be understood that the present invention may be practiced otherwise-than as specifically described herein without departing from the scope and spirit thereof.

What is claimed is:

1. A voltage regulator comprising:

voltage supply means for supplying an input voltage for powering a load;

current control signal generating means for detecting the input voltage and for generating a corresponding current control signal to control a current flowing through the load; and load current limiting means for controlling the current flowing from the voltage supply means through the load in accordance with the current control signal such that the input voltage does not fall below a predetermined value.

2. A voltage regulator according to claim 1; wherein the current control signal generating means comprises voltage dividing means for dividing the input voltage, reference voltage generating means for generating a reference voltage, and an arithmetic circuit means for generating the current control signal in accordance with the difference between the divided voltage output from the voltage dividing means and the reference voltage output from the reference voltage generating means.

3. A voltage regulator according to claim 2; wherein the load current limiting means comprises a transistor connected to the voltage supply means and to the electric load circuit means.

4. A voltage regulator according to claim 2; wherein the arithmetic circuit means comprises a differential amplifier for determining a difference between the divided voltage output by the voltage dividing means and the reference voltage and for providing an output signal in accordance with the difference.

5. A voltage regulator according to claim 1; wherein the voltage supply means comprises a battery.

6. A voltage regulator according to claim 1; wherein the voltage supply means comprises a battery and a boosting circuit.

7. A voltage regulator according to claim 1; wherein the current control signal generating means comprises divided resistors for dividing the voltage of the voltage supply means, a differential amplifier connected between the divided resistors for generating a current control signal to control a current flowing through the load means, and a reference voltage generator for providing a reference voltage to the differential amplifier.

8. A regulator comprising: means for detecting an output voltage of a power supply; and means for regulating a current flowing from the power supply through a load such that the output voltage does not fall below a predetermined value.

9. A regulator according to claim 8; wherein the power supply comprises a battery.

10. A regulator according to claim 8; wherein the means for detecting comprises voltage divider means for outputting a divided voltage in accordance with the output voltage of the power supply.

11. A regulator according to claim 8; wherein the means for regulating comprises a reference voltage generator for generating a reference voltage, a differential amplifier for determining the difference between the divided voltage and the reference voltage and for providing a current control signal in accordance with the difference, and a transistor connected to the power supply, the load and the differential amplifier for receiving the current control signal and for controlling the current flowing through the load in accordance therewith.

* * * * *